United States Patent [19]

Sugita et al.

[11] Patent Number: 4,750,921

[45] Date of Patent: Jun. 14, 1988

[54] ELECTROSTATIC FILTER DUST COLLECTOR

[75] Inventors: Naoki Sugita, Urawa; Yutaka Hatta, Koshigaya, both of Japan

[73] Assignee: Midori Anzen Industry Co., Ltd., Tokyo, Japan

[21] Appl. No.: 14,156

[22] Filed: Feb. 11, 1987

Related U.S. Application Data

[63] Continuation of Ser. No. 749,407, Jun. 27, 1985, abandoned.

[30] Foreign Application Priority Data

Jun. 22, 1984 [JP] Japan ..... 59-128494

[51] Int. Cl.[4] ..... B03C 3/12; B03C 3/45

[52] U.S. Cl. ..... 55/132; 55/138; 55/155

[58] Field of Search ..... 55/132, 155, 521, 138

[56] References Cited

U.S. PATENT DOCUMENTS

| | | | |
|---|---|---|---|
| 2,206,684 | 7/1940 | Yant | 55/521 X |
| 2,297,601 | 9/1942 | Williams | 55/132 |
| 2,868,319 | 1/1959 | Rivers | 55/132 |
| 2,915,426 | 12/1959 | Poelman | 55/521 X |
| 3,871,851 | 3/1975 | Neumann | 55/521 |
| 4,509,958 | 4/1985 | Masuda et al. | 55/132 |

FOREIGN PATENT DOCUMENTS

| | | | |
|---|---|---|---|
| 2034670 | 1/1972 | Fed. Rep. of Germany | 55/521 |
| 579096 | 7/1958 | Italy | 55/521 |
| 182106 | 1/1963 | Sweden | 55/521 |
| 892908 | 4/1962 | United Kingdom | 55/132 |

*Primary Examiner*—Kathleen J. Prunner

*Attorney, Agent, or Firm*—Chilton, Alix & Van Kirk

[57] ABSTRACT

This electrostatic filter dust collector has a dust collecting section which is assembled by using a mini-pleat type filter member having a small width of the fold thereof and a short distance between the adjacent ridge portions thereof, whereby the dust collector is reduced in both its size and thickness. Since a plurality of spacers are inserted into the filter member from the upstream and downstream sides thereof, the percentage of the contacting area of the spacers with respect to the filter member is low, and the percentage of the dust collecting area thereof is high. In addition, it is possible to obtain a sufficiently large insulating distance. Either or both of the upstream and downstream spacers are electrically conductive, and a high voltage is applied between the corresponding conductive spacers, so that a uniform and stable electric field is generated on the filter member as a whole. This enables a high dust collecting efficiency to be obtained.

2 Claims, 6 Drawing Sheets

ELECTROSTATIC FILTER DUST COLLECTOR

This is is a continuation of co-pending application Ser. No. 749,407 filed on June 27, 1985 and now abandoned.

SUMMARY OF THE INVENTION

1. Field of the Invention

This invention relates to an electrostatic filter dust collector for use in cleaning the dust-containing air and a dust containing gas.

2. Prior Art

There is a conventional electrostatic filter dust collector using in its dust collecting section a filter medium which consists as shown in FIG. 1 of a filter member 1 of glass fiber folded so as to form ridge portions 2, 3 at the upstream and downstream portions thereof with respect to a direction in which a dust-containing gas flows, and spacers 4, 5 inserted between the opposed surfaces of adjacent ridge portions 2, 3 from the upstream side and downstream side thereof. If the width $d_1$ of the fold of this filter member 1 is reduced, it becomes difficult to keep the filter member 1 and the spacers 4, 5 in the accurate folded position and the accurate inserted positions, respectively, during the assembling of the dust collecting section. In consequence, it becomes difficult to assemble the dust collecting section. This fact imposes restrictions on the miniaturization and thickness-reduction of the dust collecting section of the filter dust collector. If the distance $d_2$ between the adjacent ridge portions 2, 3 is reduced, the percentage of the contacting area of the spacers 4, 5 with respect to the filter member 1 increases, so that the dust collecting area of the filter member 1 decreases accordingly.

3. Objects of the Invention

An object of the present invention is to provide an electrostatic filter dust collector which has smaller dimensions including the thickness and a higher dust collecting efficiency than the above-described conventional electrostatic filter dust collector.

Another object of the present invention is to provide an electrostatic filter dust collector which is used as a high-performance filter for clean benches, clean tunnels and clean zone units, and an air cleaner.

BRIEF DESCRIPTION OF THE DRAWINGS

The above and other objects as well as advantageous features of the invention will become apparent from the following detailed description of the preferred embodiment taken in conjunction with the accompanying drawings.

FIGS. 2–7 show an embodiment of the present invention, wherein:

FIG. 2 is a partially cutaway perspective of a charging section;

FIG. 3 is a partially cutaway perspective of a dust collecting section;

FIG. 4 is an enlarged perspective showing the construction of a filter member;

FIG. 5 is a schematic diagram of the electrostatic filter dust collector in which the dust collecting section is connected to the charging section;

FIG. 6 shows a modification of spacers provided on the filter member; and

FIG. 7 shows another modification of the spacers provided on the filter member.

DETAILED DESCRIPTION OF THE INVENTION

Figure 1:
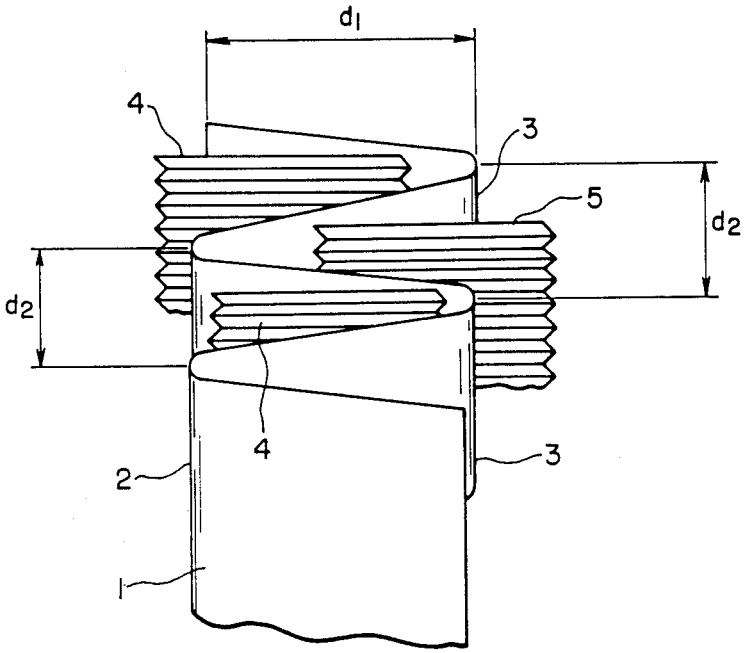
FIG. 1 PRIOR ART
FIG. 1 illustrates how to assemble a dust collecting section of a conventional electrostatic filter dust collector.
Figure 2:
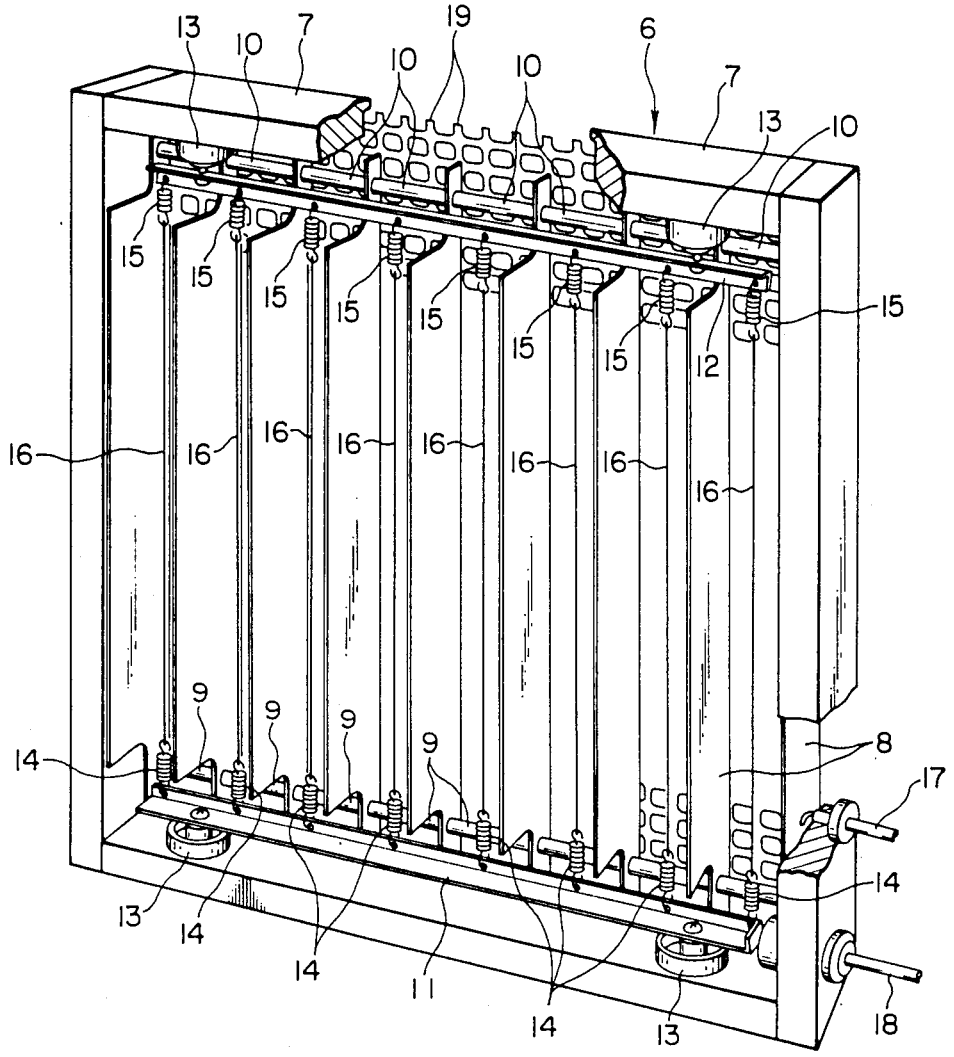
Figure 3:
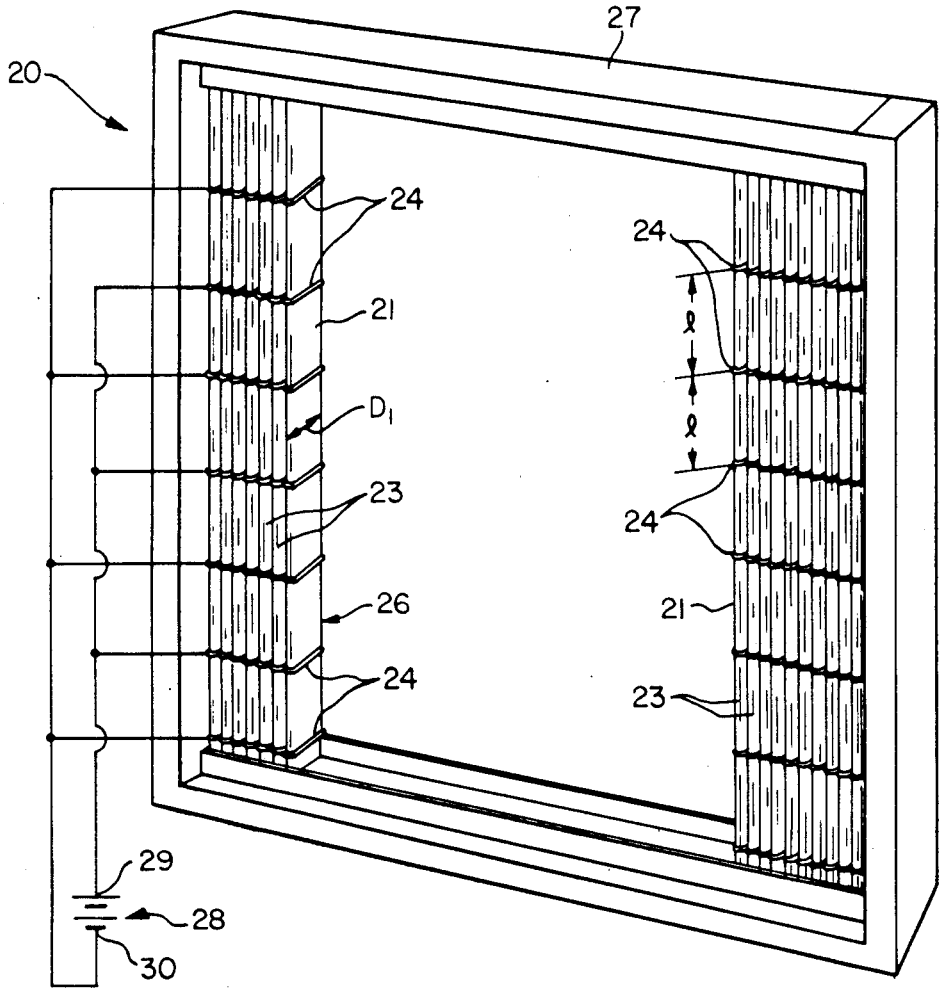
Figure 4:
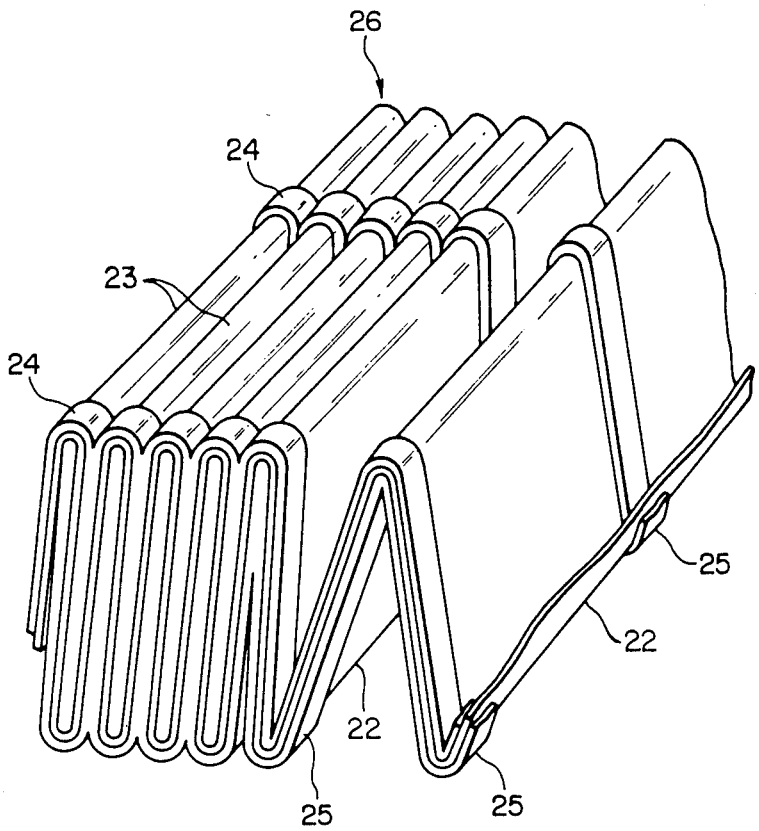

An embodiment of the present invention will now be described with reference to FIGS. 2–5. Reference numeral 6 denotes a charging section, which consists of a frame 7 through which the dust-containing air is passed, a plurality of flat electrodes 8 provided on the inner side of the frame 7 so as to extend at regular intervals and in parallel with the direction in which the dust-containing air flows, conductive spacers 9, 10 provided among narrowed portions formed at both end sections of the flat electrodes 8, conductive support members 11, 12 provided in the spaces defined within the frame 7 by the narrowed portions at both end sections of the flat electrodes 8, insulating seats 13 via which both end portions of the support members 11, 12 are fixed to the frame 7, springs 14, 15 joined to the portions of the support members 11, 12 which are halfway between the adjacent flat electrodes 8, discharge wires 16 provided in a tensed state between the springs 14, 15, a lead wire 17 to be grounded which is connected to the flat electrode 8 positioned near the inner surface of one side member of the frame 7, a high-voltage-applying lead wire 18 connected to the support member 11, and a net member 19 having openings of a suitable size and attached to an inlet for the dust containing air of the frame 7. Reference numeral 20 denotes a dust collecting section to be joined to an outlet for the dust containing air of the charging section 6 having the above-mentioned construction. The dust collecting section 20 employs a filter 26 which consists of a filter member called a mini-pleat type filter member, i.e., a filter member 21 of glass fiber which is folded to a small width $D_1$, for example, not more than 100 mm so as to form alternate ridge portions 22, 23 at the upstream and downstream portions thereof with respect to the direction in which the dust-containing air flows.

A plurality of conductive spacers 24 and a plurality of insulating spacers 25 consisting of plastic straps or tapes are inserted in downstream and upstream pairs into the portions of the spaces defined by the surfaces of adjacent folds of the filter member 21, from the upstream side and downstream side of the same member 21, so as to maintain the distance $D_2$ between the adjacent ridge portions 22, 23 small, for example, at not more than 5 mm, and the spacers 24, 25 are then bonded to the filter member 21. The upstream and downstream pairs form a plurality of bands which are spaced from each other by a suitable distance l.

The filter 26 thus constructed is fitted in a frame 27 which has the same shape as the frame 7 for the charging section 6, and the circumferential portion of the filter 26 is bonded air-tightly to the inner surface of the frame 27. The plurality of conductive spacers 24 are alternately connected with a high-voltage side terminal 29 and a ground-side terminal 30 of a high-voltage device 28 in the manner shown in FIG. 3. A packing (not shown) is attached to such a portion of the frame 27 that is to be joined to the frame 7.

Figure 5:
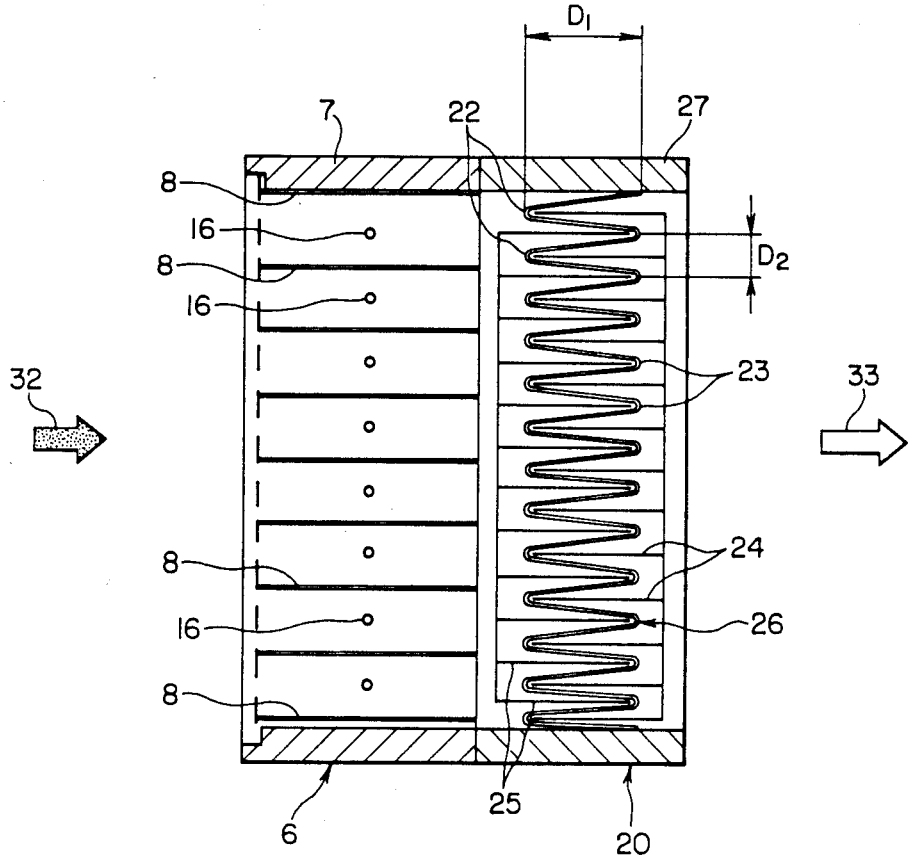

The dust-collecting section 20 constructed as mentioned above is joined to the charging section 6 as shown in FIG. 5. A high voltage is applied to the discharge wires 16 in the charging section 6 to generate corona discharge, and a high voltage between the conductive spacers 24 in the dust collecting section 20 to generate a high electric field. The dust-containing air 32 is then introduced into the inlet of the charging section 6 by means of a blower. Consequently, while the dust-containing air 32 passes through the charging section 6, the dust in the air 32 is electrically charged to turn into charged particles. While the dust-containing air 32 thereafter passes through the dust collecting section 20, these charged particles receive the actions of the high electric field between the conductive spacers 24, and are adsorbed around the fibers of the filter member 21. As a result, the dust-containing air 32 is cleaned, and the resultant clean air 33 is sent out from the outlet of the dust collecting section 20.

Figure 6:
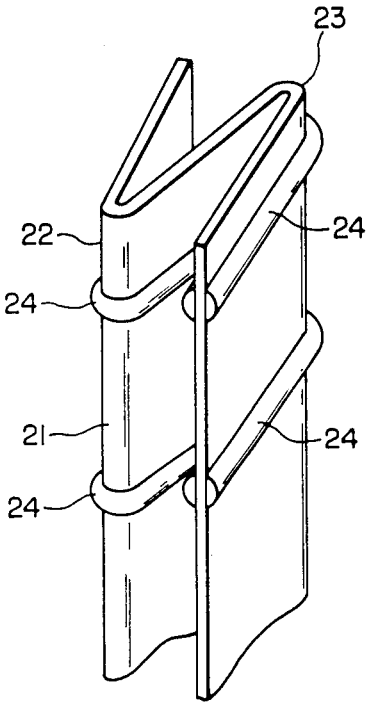
Figure 7:
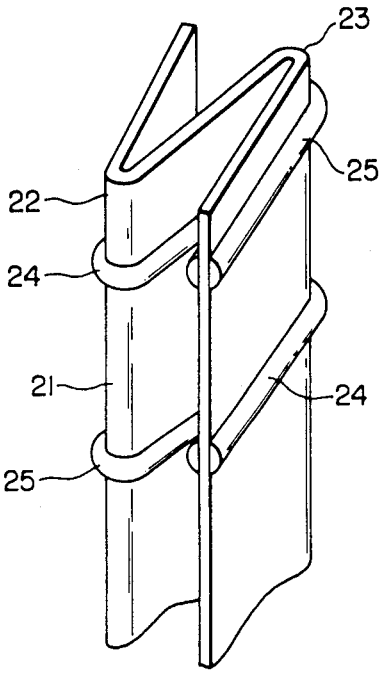

Although in the above-described embodiment the conductive spacers 24 are provided on the downstream side of the filter member 21, the present invention is not necessarily limitative thereto. For example, the arrangement may be such that, as shown in FIG. 6, a plurality of conductive spacers 24 are provided on both the downstream and upstream sides of the filter member 21, and a high voltage is applied between the adjacent spacers 24 on the upstream side, and a high voltage is also applied between the adjacent spacers 24 on the downstream side. Further, it is also possible to employ an arrangement, such as that shown in FIG. 7, wherein a plurality of conductive spacers 24 and a plurality of nonconductive spacers 25 are alternately provided on both the downstream and upstream sides of the filter member 21 in such a manner that each of the spacers 24 on the downstream side opposes each of the spacers 25 on the upstream side across the filter member 21, while each of the spacers 25 on the downstream side opposes each of the spacers 24 on the upstream side across the filter member 21, and a high voltage is applied between each of the conductive spacers 24 on the upstream side and the corresponding one of the conductive spacers 24 on the downstream side. Furthermore, in the present invention, either a high AC or DC voltage may be applied to the conductive spacers.

Since the present invention employs a mini-pleat type filter member as mentioned above, the width of the fold thereof can be reduced, and the proper folded condition thereof can be retained accurately by the plurality of spacers bonded thereto. This enables the thickness-reduced, miniaturized dust collecting section to be assembled simply. Moreover, the distance between the adjacent ridge portions of the filter member is short, and the contacting area of each spacer with respect to the filter member is small. Therefore, the dust collecting area can be increased. Since it is possible to obtain a sufficiently large insulating distance l betwen the adjacent conductive spacers, insulating of the spacers can be done easily. Even when a high voltage is applied between the adjacent conductive spacers, an accident does not occur. Even when the humidity is high, a leakage current rarely occurs. Therefore, the stable characteristics of the dust collector can be maintained constantly. Although the width $D_1$ of the fold of the filter member may vary depending upon the flow rate of air or the wind velocity, it is possible for the distance l between the adjacent conductive spacers to be maintained at a constant value. It is therefore possible to apply a constant high voltage to various filter members which are different from each other in terms of the width $D_1$. In other words, it is possible for the same high-voltage power source to be employed for filter members of different widths $D_1$, and it is therefore unnecessary to adjust the voltage to be applied every time the width $D_1$ changes. Since the insulating distance between the adjacent conductive spacers is constant, a uniform, high electric field can be generated in the filter member as a whole. Owing to these advantages as well as the large dust collecting area of the filter member, a dust collecting section having an extremely high dust collecting efficiency can be obtained. Accordingly, this invention can provide a thin, miniaturized electrostatic filter dust collector having a high dust collecting efficiency and capable of being used as a superhigh performance filter for clean benches, clean tunnels and clean zone units, an air cleaner and various other filtering devices.

We claim:

1. An electrostatic filter dust collector having a charging section through which dust-containing gas is passed to subject the floating dust particles therein to preliminary electric charging, and a dust collecting section provided with an insulating filter member which is used to collect under the actions of an electric field the charged particles in the dust containing gas passed through said charging section, characterized in that said insulating filter member is folded so as to form ridges at the upstream and downstream sides thereof alternately, a plurality of spacer pairs for use in retaining a predetermined gap between the surfaces of the adjacent folded parts of said filter member being inserted between said adjacent folded parts, each spacer pair formed by an upstream spacer and a downstream spacer facing each other on opposite sides of and fixed to said filter member, the spacer pairs arranged in a plurality of bands generally transverse to said ridges, said bands separated from each other by a predetermined distance, the upstream spacer on every band being non-conducting, and the downstream spacer on every band being conducting wherein the conductive spacer on a first band is connected to a source of uniform higher voltage relative to the conductive spacer on an adjacent second band, alternatingly.

2. An electrostatic filter dust collector having a charging section through which a dust-containing gas is passed to subject the floating dust particles therein to preliminary electric charging, and a dust collecting section provided with an insulating filter member which is used to collect under the actions of an electric field the charged particles in the dust containing gas passed through said charging section, characterized in that said insulating filter member is folded so as to form ridges at the upstream and downstream sides thereof alternately, a plurality of spacer pairs for use in retaining a predetermined gap between the surfaces of the adjacent folded parts of said filter member being inserted between said adjacent folded parts, each spacer pair formed by an upstream spacer and a downstream spacer facing each other on opposite sides of and fixed to said filter member, the spacer pairs arranged in a plurality of bands generally transverse to said ridges, said bands separated from each other by a predetermined distance, wherein a first band comprises a conducting upstream spacer and a non-conducting downstream spacer, an adjacent band comprises a non-conducting upstream spacer and a conducting downstream spacer and the conductive spacer on the first band is connected to a source of uniform higher voltage relative to the conductive spacer on the adjacent second band, alternatingly.

* * * * *